US008695650B2

(12) United States Patent
Walz

(10) Patent No.: US 8,695,650 B2
(45) Date of Patent: Apr. 15, 2014

(54) LIQUID FILLER SYSTEM AND CONTAINER FILLING DEVICE

(75) Inventor: John C. Walz, South Dennis, MA (US)

(73) Assignee: Solbern, Inc., Fairfield, NJ (US)

( * ) Notice: Subject to any disclaimer, the term of this patent is extended or adjusted under 35 U.S.C. 154(b) by 720 days.

(21) Appl. No.: 12/890,250

(22) Filed: Sep. 24, 2010

(65) Prior Publication Data

US 2011/0073215 A1 Mar. 31, 2011

Related U.S. Application Data

(60) Provisional application No. 61/245,801, filed on Sep. 25, 2009.

(51) Int. Cl.
*B65B 39/00* (2006.01)

(52) U.S. Cl.
USPC ..... 141/343; 141/126; 141/135; 141/198; 141/230; 141/297

(58) Field of Classification Search
USPC ..... 141/121, 124, 126, 133, 135, 150, 198, 141/230, 297–300, 340–343
See application file for complete search history.

(56) References Cited

U.S. PATENT DOCUMENTS 2,694,515 A 11/1954 Green
2,951,514 A 9/1960 Flack
3,228,434 A 1/1966 Johnson et al.
3,316,945 A 5/1967 Brinkley et al.
4,103,720 A 8/1978 Eisenberg
4,273,166 A * 6/1981 Bradley ..... 141/95
4,349,053 A 9/1982 Eisenberg
5,638,873 A 6/1997 Burns

OTHER PUBLICATIONS

International Patent Application No. PCT/US10/50228, filed Sep. 24, 2010, claiming priority to Provisional U.S. Appl. No. 61/245,801 (41 pages).
International Search Report of the International Searching Authority, mailed Nov. 10, 2010, issued in connection with International Patent Appln. No. PCT/US10/50228 (3 pages).
Written Opinion of the International Searching Authority, mailed Nov. 10, 2010, issued in connection with International Patent Appln. No. PCT/US/10/50228 (5 pages).

* cited by examiner

*Primary Examiner* — Jason K Niesz
(74) *Attorney, Agent, or Firm* — McCarter & English, LLP

(57) ABSTRACT

A container filling device is provided for filling a container with desired headspace. The container filling device includes a siphon and a funnel having a bottom region configured to engage a container. The siphon extends through an opening in the bottom region and a sidewall such that a first end of the siphon has a first elevation and a second end of the siphon has a lower elevation than the first elevation. The bottom region is provided with an opening for the outflow of liquid from the receiving area into the container. Excess liquid flowing into the container beyond a desired headspace escapes from the container through the siphon. A liquid filler system can be provided with a frame, a plumbing system, and an alignment system for engaging and disengaging the container filling device with the container.

53 Claims, 14 Drawing Sheets

LIQUID FILLER SYSTEM AND CONTAINER FILLING DEVICE

CROSS-REFERENCE TO RELATED APPLICATIONS

The present invention claims the benefit of priority to U.S. Provisional Application No. 61/245,801, filed Sep. 25, 2009, the contents of which are herein incorporated by reference in their entirety.

FIELD OF THE INVENTION

The present invention relates to apparatus and methods for filling containers with a liquid. More specifically, the present invention relates to systems and methods for filling containers with a desired headspace and reduced mess.

BACKGROUND OF THE INVENTION

It is desirable in the bottling industry that the filling of containers with liquid be done efficiently and with reduced mess. The prior art includes attempts at accomplishing this. For example, expired U.S. Pat. No. 4,349,053 (the "'053 Eisenberg Patent"), the contents of which are hereby incorporated by reference in their entirety, discloses a method and apparatus for filling containers with liquid. Referring to the '053 Eisenberg Patent, and, as reproduced in part therefrom as FIGS. 1A and 1B of the present application, the '053 Eisenberg Patent discloses containers 10 set on pivoting mounts 12 with liquid flow being channeled from weirs 14 into the open tops of the containers 10. To reduce system complexity, the '053 Eisenberg Patent allows for an overflow condition, and excess liquid received by a container 10 is poured out into a trough 16 for recirculation ultimately back to weir 14. To reduce mess, e.g., to minimize contact between the liquid and an exterior of the containers 10 during an overfill, the containers 10 are tilted away from the liquid flow, though such provides a headspace 18 at the top of the container 10 that might be undesirably large. What is needed in the art are systems and methods for filling containers with a liquid so as to provide reduced headspace and reduced mess in connection with an overfill condition.

SUMMARY OF THE INVENTION

The present invention overcomes the disadvantages and shortcomings of the prior art by providing a container filling device, which, in response to an overfill condition, evacuates excess liquid to provide a desired amount of headspace, if any.

In some embodiments of the invention, the container filling device includes a siphon and a funnel, wherein the funnel has a multi-chambered opening with a chamber through which the siphon extends and with one or more outflow chambers. The container filling device is preferably configured to engage a container, such that the siphon extends into the container at an elevation corresponding with a desired headspace. The container filling device is configured such that liquid flows through the outflow chamber(s) of the funnel into the container, e.g., a bottle, and such that liquid in excess of the desired headspace is evacuated by the siphon.

In some embodiments of the invention, a liquid filler system is provided which includes the container filling device. The liquid filler system can further include a plumbing system for recirculation of liquid to and from the container filling device, such as a plumping system comprising a weir subsystem from which liquid flows to the funnel and a trough to which liquid flows from the siphon. The liquid filler system can include an alignment system for automated mechanical alignment of the container filling device and the container (onto a common axis, for example), as well as engagement and disengagement of the container and container filling device with one another (e.g., along the axis) during operation of the plumbing system. For example, it is contemplated that the alignment system can include a turret and star wheel configuration for achieving and maintaining alignment between a bottle and a container filling device along a vertical axis. Continuing with the example, the alignment system can further include components for aligning along the horizontal the bottle and the container filling device, thereby alternatively engaging and disengaging same. Such components can include a fixed elevation member securing at least one of the bottle and the container filling device to the rotating turret, as well as a variable elevation member securing the other one of the bottle and the container filling device to the rotating turret, a variable elevation track circumscribing the turret, and a cam follower engaging the variable elevation track and secured to the variable elevation member to raise and lower same with respect to the fixed elevation member as the elevation of the track increases and decreases.

Additional features, functions and benefits of the disclosed liquid filler system and container filling device will be apparent from the detailed description which follows, particularly when read in conjunction with the accompanying figures.

BRIEF DESCRIPTION OF THE DRAWINGS

For a more complete understanding of the present invention, reference is made to the following detailed description of exemplary embodiment(s) considered in conjunction with the accompanying drawings, in which.

DETAILED DESCRIPTION OF THE EXEMPLARY EMBODIMENTS

Figure 1A:
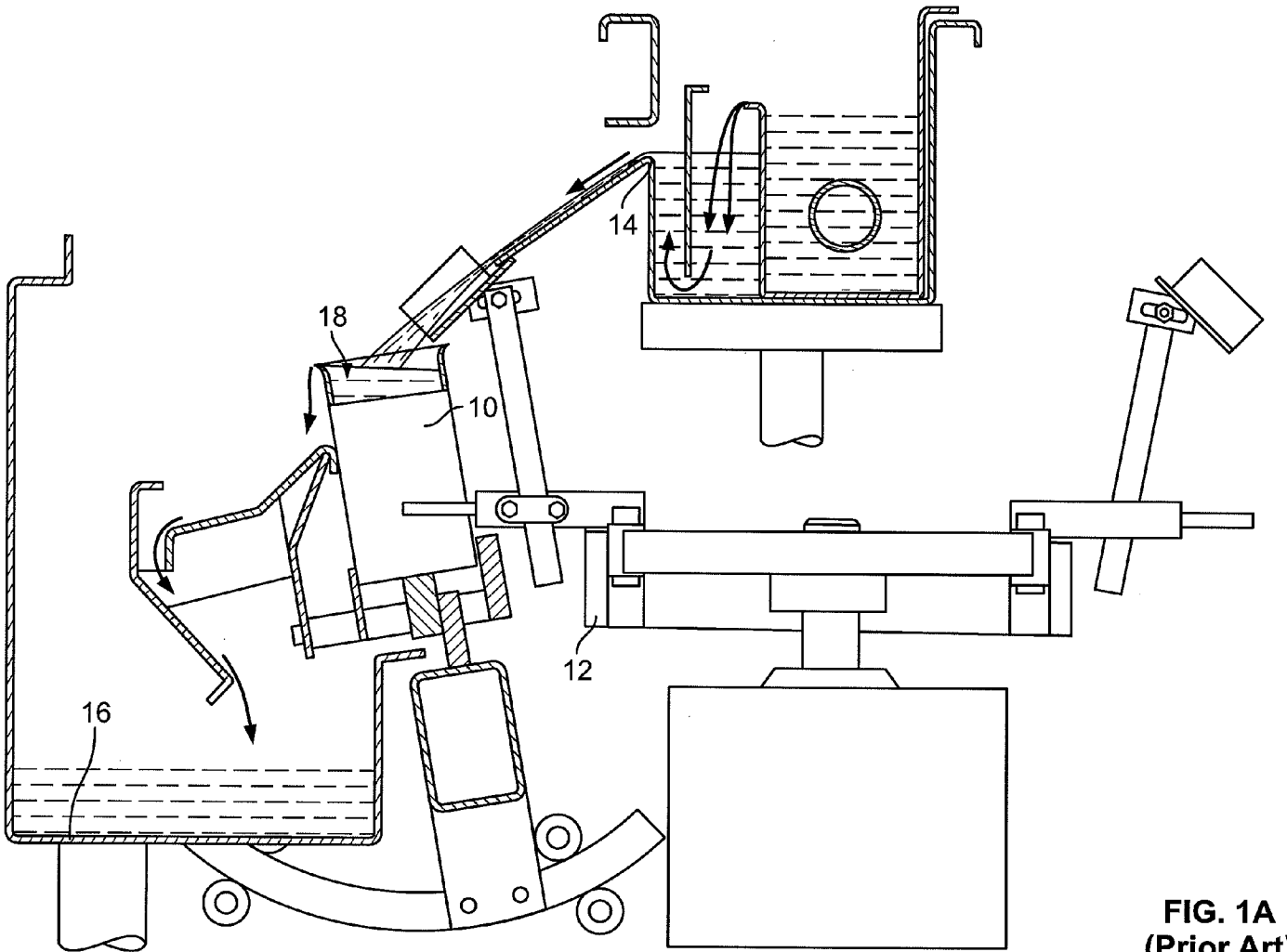
FIG. 1A (Prior Art)
FIG. 1A shows a prior art apparatus for filling containers with liquid.
Figure 1B:
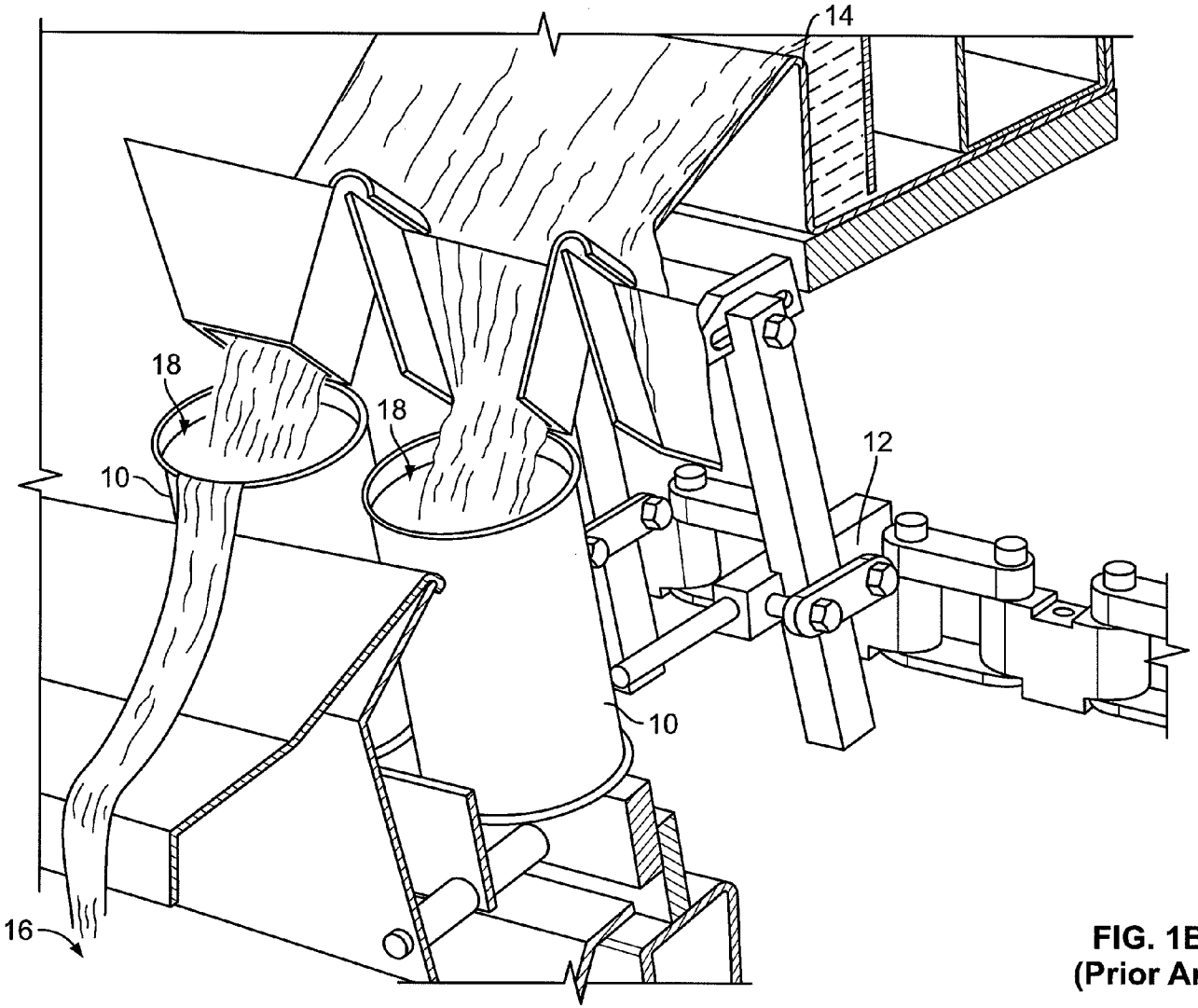
FIG. 1B (Prior Art)
FIG. 1B shows another prior art apparatus for filling containers with liquid.

Referring to FIGS. 2A-4D, a liquid filler system 20 is shown constructed in accordance with an exemplary embodiment of the present invention. The liquid filler system 20 includes a vertically-adjustable frame 22, a plumbing system 24, an alignment system 26, and a plurality of container filling devices 28. The liquid filler system 20 can be used in combination with a plurality of containers, such as, for example, a plurality of bottles 30 each having a neck section 32 (or other containers having open top sections). Any suitable frame 22, plumbing system 24, and alignment system 26 can be used.

Figure 2A:
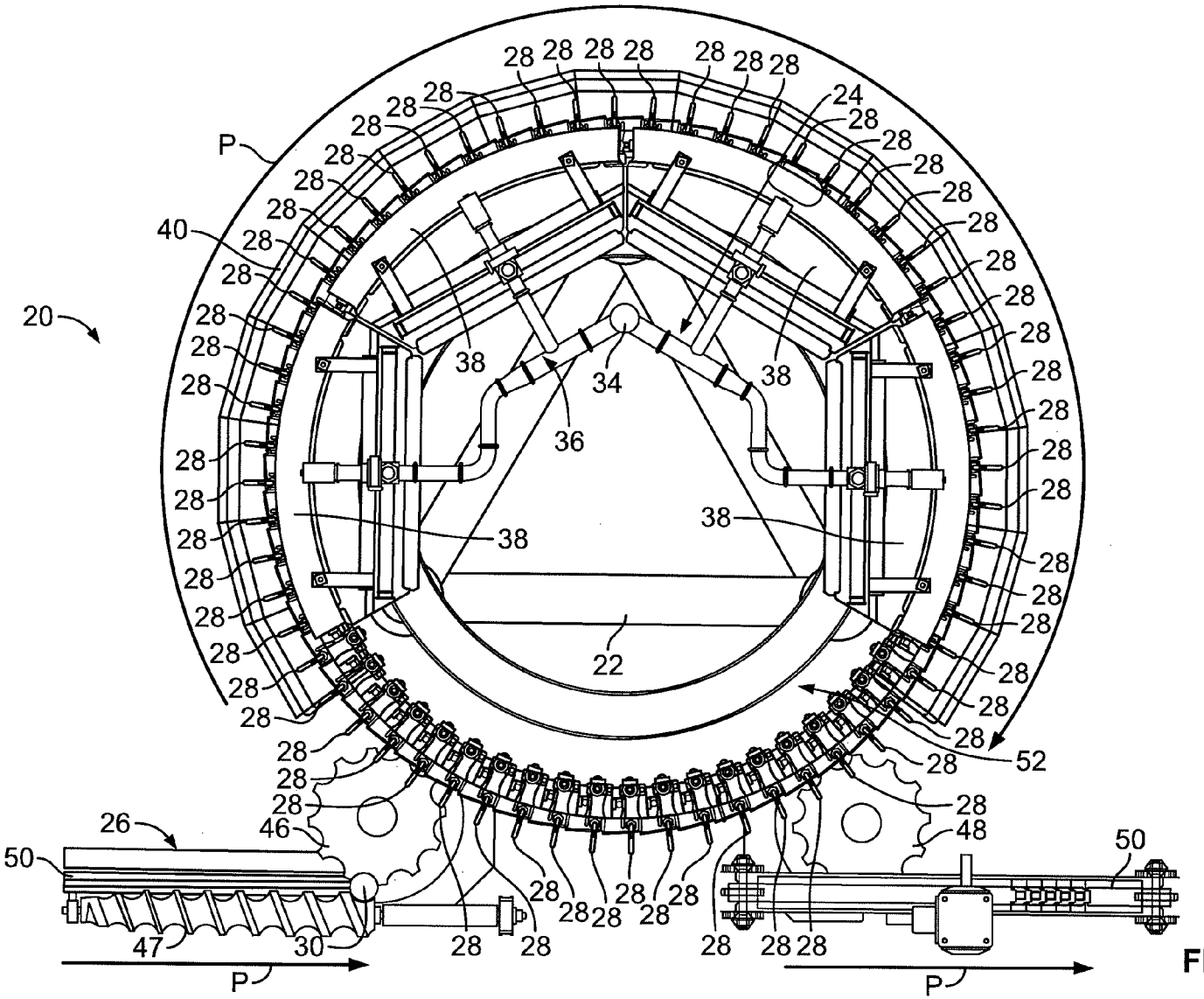
FIG. 2A is a top plan view showing a liquid filler system constructed in accordance with an embodiment of the present invention, the liquid filler system being shown to include a plurality of container filling devices in combination with a frame, a plumbing system, and an alignment system.
Figure 2B:
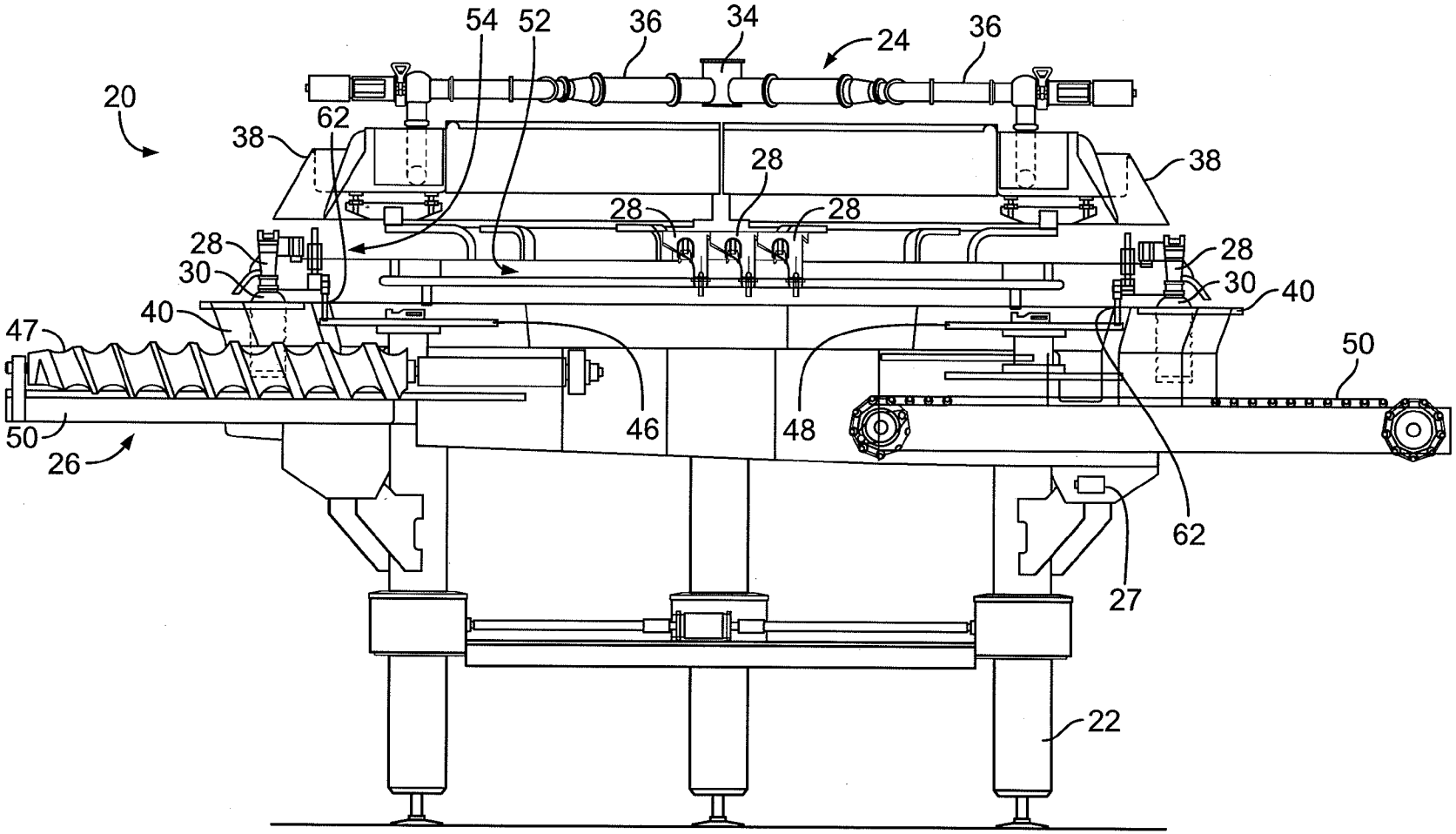
FIG. 2B is a front elevational view showing the liquid filler system of FIG. 2A with some of the container filling devices, arm assemblies, and track having been removed.
Figure 3A:
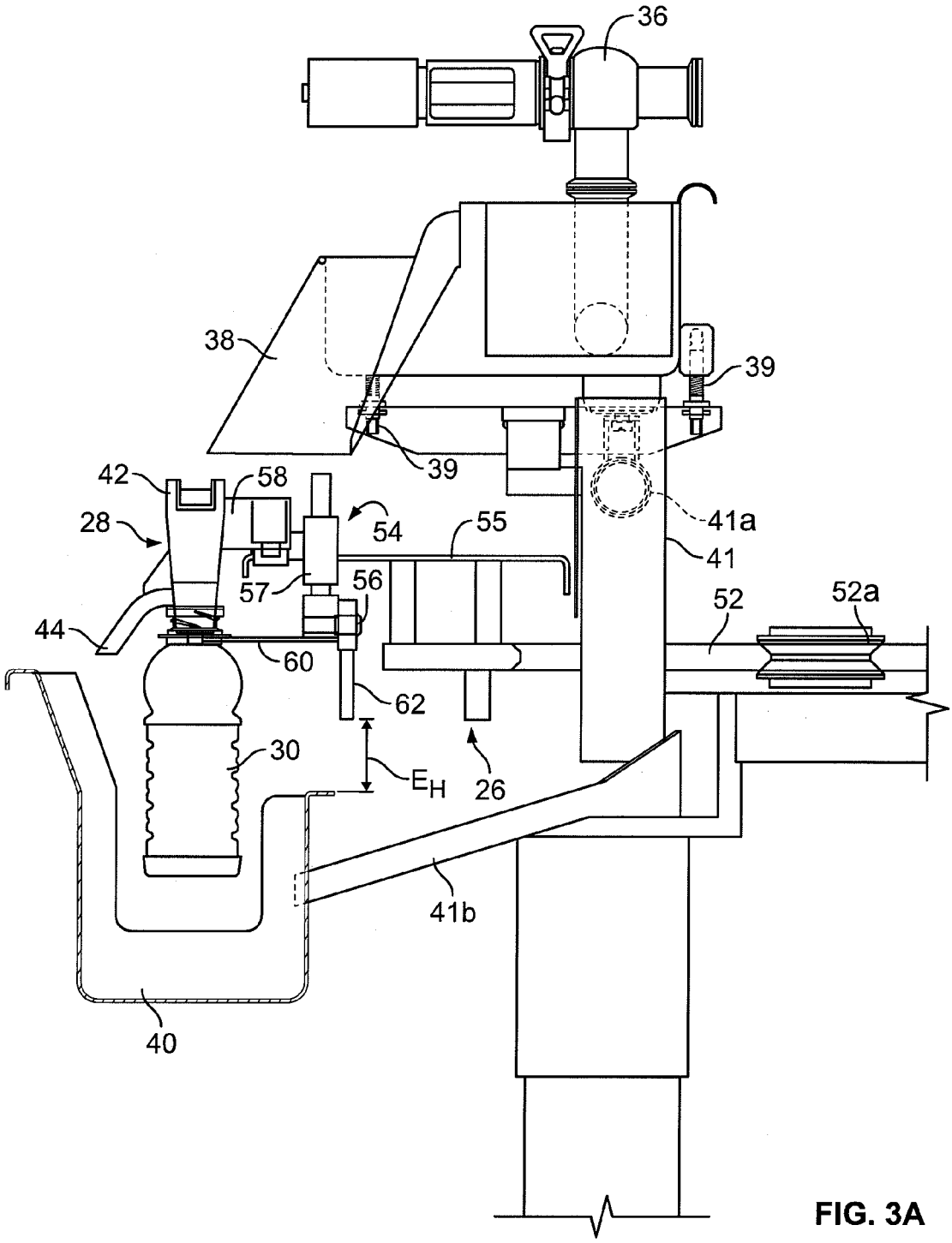
FIG. 3A is a front elevational view of portions of the liquid filler system of FIGS. 2A-2B showing engagement of a container filling device and a bottle.
Figure 3B:
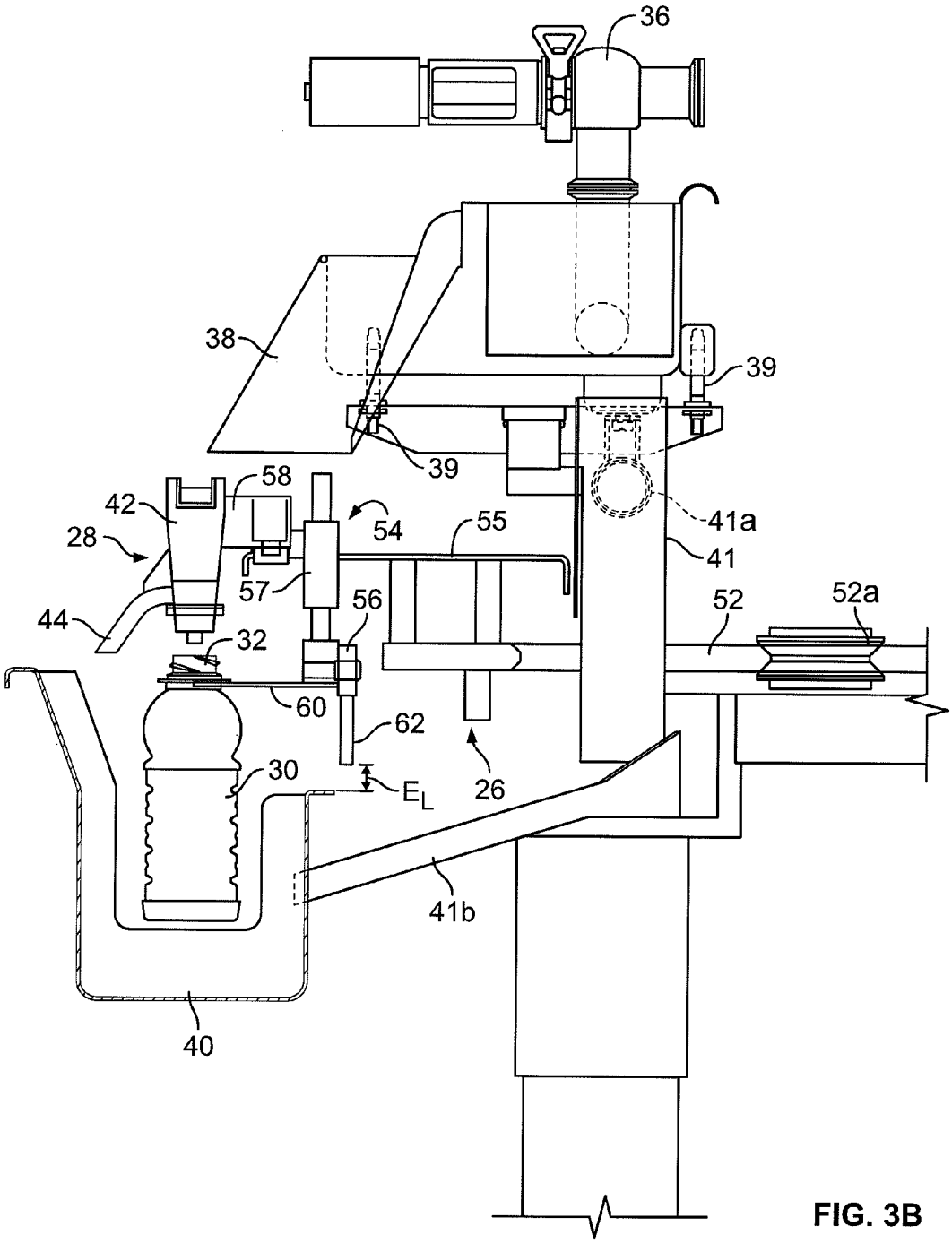
FIG. 3B is the front elevational view of FIG. 3A showing disengagement of the container filling device and the bottle.

Referring to FIGS. 2A-3B, the plumbing system 24 comprises means for delivering liquid to the container filling devices 28 and further includes means for return flow of the liquid for recirculation. For example, a plumbing system such as that disclosed in the '053 Eisenberg Patent can be included. Additionally and/or alternatively, the plumbing system 24 can include a main inflow line 34 of liquid, a manifold 36 receiving liquid from the main inflow line 34, a weir subsystem 38 receiving the liquid from the manifold 36 and diverting same to the container filling devices 28, a trough 40 for receiving overflow from the container filling devices 28, and a recirculation line (not shown) for circulating the overflow liquid back to the manifold 36, for example. Any suitable plumbing system known in the art can be used. As shown in FIGS. 3A and 3B, the weir subsystem 38 can be supported by mounting lugs 39, and a conduit 41 can be provided for draining the weirs 38 through a drain hole and down to a flow diverter 41*b* for directing the drainage to the trough 40.

The container filling devices 28 receive liquid diverted from the weir subsystem 38, and each container filling device 28 preferably includes a funnel 42 and a siphon 44, which shall be discussed further below with reference to FIGS. 4A-4D, for example. The funnel 42 and siphon 44 can be formed with each other integrally and/or as separate components. The siphon 44 is configured for being inserted into the neck section 32 of the bottle 30 when the funnel 42 is aligned therewith, and, in some aspects of the invention, a portion, e.g., bottom, of the funnel 42 proximal the siphon 44 is configured (e.g., sized and dimensioned) to mate with the neck section 32, forming at least a partial seal for reduced mess. Liquid from the weir subsystem 38 is diverted by the funnel 42 of the container filling device 28 into a corresponding bottle 30, while the corresponding siphon 44 removes excess liquid to the trough 40 to create a desired amount of headspace, if any. The bottle 30 is a type of container, and it is contemplated that the liquid filler system 20 and/or container filling device 28 can be configured for other types of container.

Continuing with reference to FIGS. 2A and 2B, the alignment system 26 includes the means by which the container filling devices 28 and bottles 30 are aligned with one another. The alignment system 26 can be presented in the form of automated machinery for an assembly line, driven by a motor, and controlled by a computerized electronic processor with a user interface, and the motor and controller are represented together schematically as motor 27 in FIG. 2B.

The alignment system 26 includes a plurality of star wheels 46, 48 and a turret 52 driven by the motor 27 to rotate. A first star wheel 46 is configured to feed bottles 30 from an upstream location on an assembly line 50 onto an entry position along the circumference of the turret 52, and a timing screw 47 is provided to facilitate same. A second star wheel 48 is provided for feeding bottles 30 from an exit position along the circumference of the turret 52 to a downstream point on the assembly line 50. The motor 27 drives the rotatable plate 52 via a plurality of plate transmission gears that are disposed circumferentially about the plate, such as gear 52*a* (shown in FIGS. 3A and 3B).

The turret 52 can be provided as a rotatable plate with sixty bottle-receiving arm assemblies 54 secured thereto and extending radially therefrom. Each arm assembly 54 is angularly displaced from each arm assembly 54 adjacent thereto by about six degrees (in the example of sixty arm assemblies 54), and, continuing the example, sixty container filling devices 28 can be angularly displaced from the container filling device 28 adjacent thereto by about six degrees. Each of the container filing devices 28 is aligned with a respective one of the arm assemblies 54, such that a bottle 30, when fed into an arm assembly 54, is in alignment with a container filling device 28 for possible engagement therewith. The container filling device 28 and the bottle 30 are preferably in alignment along a common vertical axis, and each bottle-device pair maintains its alignment along the vertical axis throughout rotation of the turret 52 until the bottle 30, filled by the plumbing system 24, is fed to a downstream location on the assembly line 50 by the second star wheel 48.

In the embodiment shown in FIG. 2A, a plurality of weirs 38 (e.g., four weirs) are shown to extend clockwise about the turret 52 from about an 8:00 position to about a 4:00 position, such that, when the turret 52 rotates the bottles 30 from the first star wheel 46 to the second star wheel 48, such rotation is clockwise. An example path P of a bottle 30 along the assembly line 50 and turret 52 is designated with the arrows P in FIG. 2A. It is contemplated that a reverse direction system could be utilized, wherein the entry (upstream) side and exit (downstream) side are reversed and the rotational direction of the turret is also reversed. It is further contemplated that the weirs 38 and track 62 could be otherwise positioned between the first and second star wheels 46, 48, e.g., on the other side of the assembly line 50.

After the bottle 30 and the container filling device 28 are aligned onto a common axis, the bottle 30 and the container filling device 28 can be further aligned by bringing them into engagement with one another along that axis. For example, at least one of the bottle 30 and the container filling device 28 undergo vertical displacement so as to be brought closer to the other along the common vertical axis. When the bottle 30 and container filling device 28 are fully-aligned, the siphon 44 extends into the neck section 32 a distance corresponding to a desired headspace. As liquid is funneled into the bottles 30, excess liquid is evacuated by the siphon 44 into the trough 40, as the downward force of the liquid from the weir subsystem 38 forces liquid up into the siphon 44.

It is contemplated that the liquid filler system 20 can include any alignment system known in the art that is suitable for aligning the bottles 30 and a filling mechanism. By way of example, and with reference to FIGS. 3A and 3B, each arm assembly 54 of the turret 52 can include an extension mount 55 secured to the plate of the turret 52 and a fixed elevation member 57 fixedly secured to a guide rod of the extension mount 55, while each one of the container filling devices 28 can be provided with a filling device mount 58 for securingly mounting the container filling device 28 to the fixed elevation member 57 of the arm assembly 54. For example, the filling device mount 58 can be provided as a plurality of resiliently flexible fingers and a bore for attachment to the fixed elevation member 57.

Each arm assembly 54 can further include a variable elevation member, e.g., fork 60, releasably receiving the neck section 32 of the bottle and movably secured to the guide rod of the extension mount 55. Each arm assembly 58 includes a cam follower 56 secured to the variable elevation member, e.g., fork 60, for raising and lowering same. The turret 52 is provided with a track 62 secured atop the frame 22. The track 62 is annular from a plan view extending about the path P. The beginning or entry point of the track 62 is proximal the first star wheel 46 and the end or exit point of the track is proximal the second star wheel 48. The track 62 has a lower elevation $E_L$ proximal the star wheels 46, 48 and a higher elevation $E_H$ therebetween. Lower elevation $E_L$ and higher elevation $E_H$ are designated with respect to the top of the trough 40 in FIGS. 3A and 3B to facilitate discussion of same, though the measure of elevation can be taken with respect to another baseline, such as ground.

The cam follower 56 of each arm assembly 54 rides on the track 62, such that, as the turret 52 rotates each arm assembly 54 from the first star wheel 46 to the second star wheel 48, the cam follower 56 causes the movable fork 60 to rise in elevation from a disengaged position at the lower elevation $E_L$ of the annular track 62, such as that shown in FIG. 3B, to an engaged position at a higher elevation $E_H$ of the annular track 62, such as that shown in FIG. 3A, where the container filling device 28 is further aligned, e.g., engaged, with the bottle 30 for siphoning liquid corresponding to a desired amount of headspace, if any. As the track 62 returns to lower elevation $E_L$ for providing the filled bottle 30 to the second star wheel 48, the cam follower 56 allows the movable fork 60 to return to a lower point of elevation $E_L$ to be fed to the downstream portion of the assembly line 50.

Continuing with reference to FIGS. 4A-4D, the funnel 42 of each container filling device 28 includes a liquid receiving area 64, an open top 66 for liquid flow into the receiving area 64, a rear wall 68 secured to the fixed member 58, a front wall 70 opposite the rear wall 68 and provided with a hole 72, a plurality of side walls 74, 76, and a bottom region 78, which shall be discussed further below. Each funnel 42 can additionally include a deflecting member 80, which, as disclosed in the '053 Eisenberg patent, can be provided to minimize inter-funnel overflow. In some embodiments, a flange 82 circumscribes the walls 68, 70, 74, 76 for purposes described below and with the bottom region 78 below the flange 82. The bottom region 78 is sized and dimensioned with a complementary geometry to fit at least partially within the neck section 32 of a bottle 30, for example, and so as to form an at least partial seal therewith. The container filling device 28 is provided with a filling device mount 158, as described above, for example.

Figure 4A:
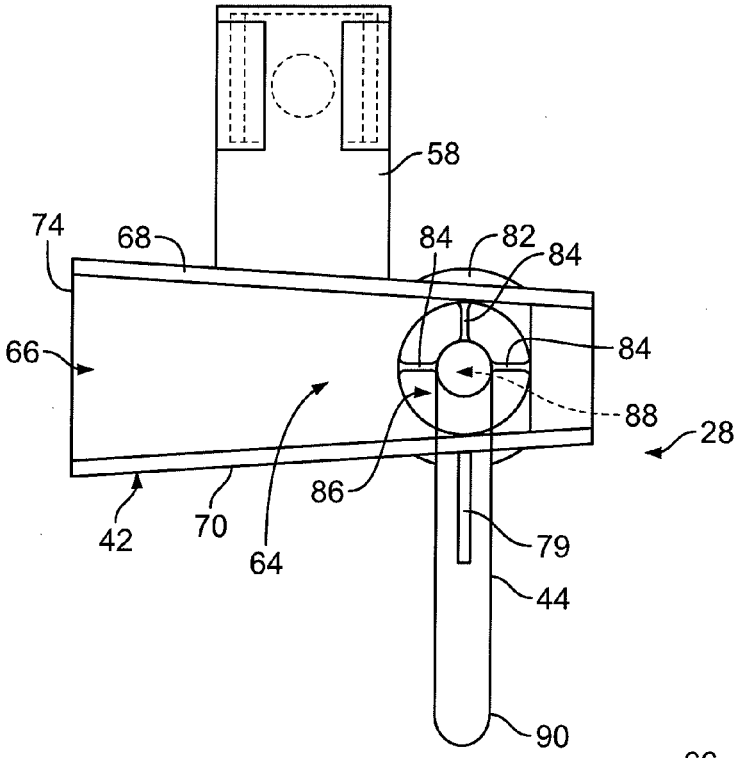
FIG. 4A is a top plan view of the container filling device of FIGS. 2A-3B.
Figure 4B:
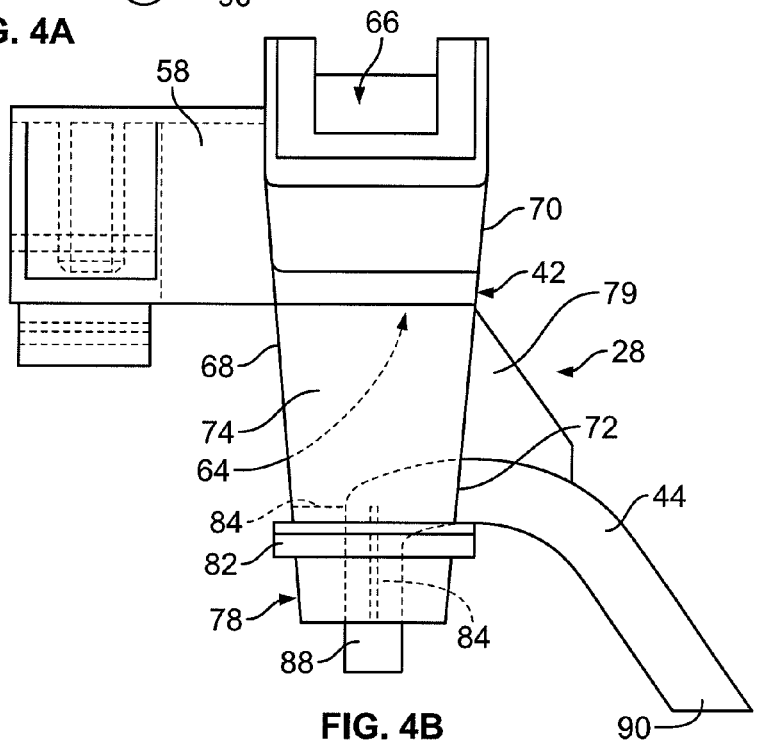
FIG. 4B is a left side elevational view of the container filling device of FIGS. 2A-4A.
Figure 4C:
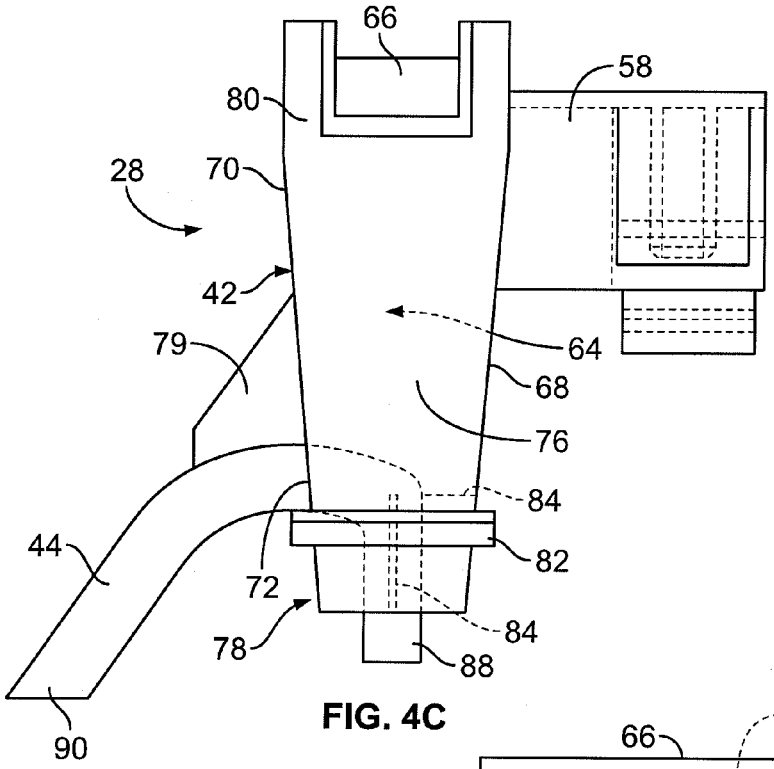
FIG. 4C is a right side elevational view of the container filling device of FIGS. 2A-4B.
Figure 4D:
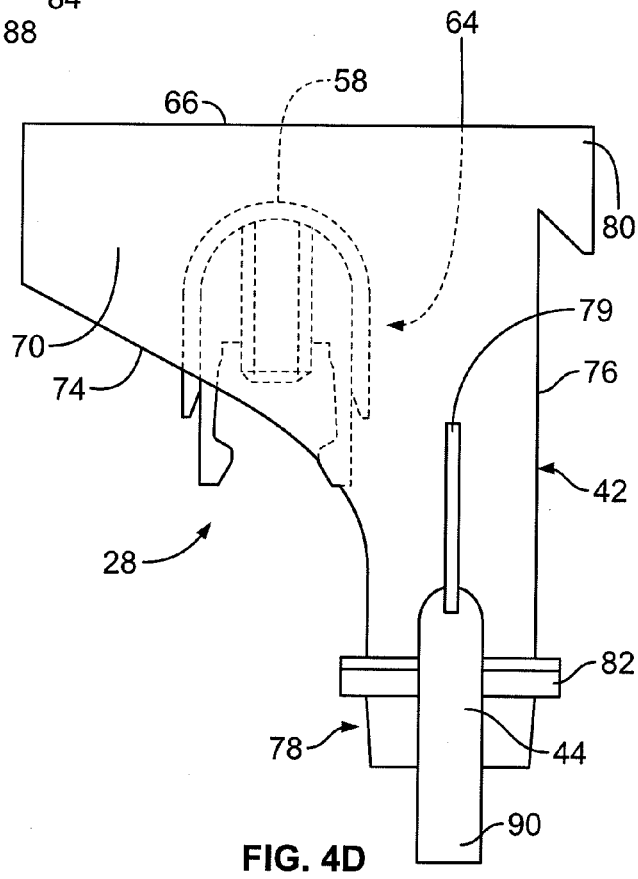
FIG. 4D is a front elevational view of the container filling device of FIGS. 2A-4C.
Figure 5A:
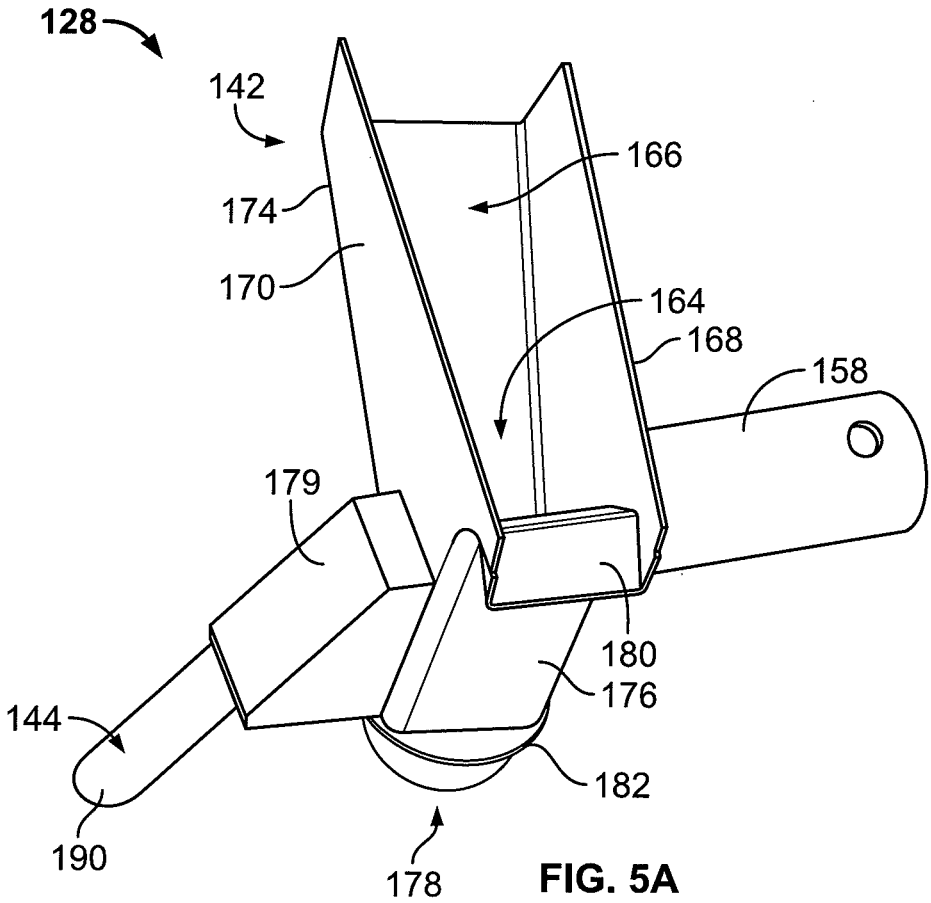
FIG. 5A is a perspective view showing a container filling device constructed in accordance with another embodiment of the present invention.
Figure 5B:
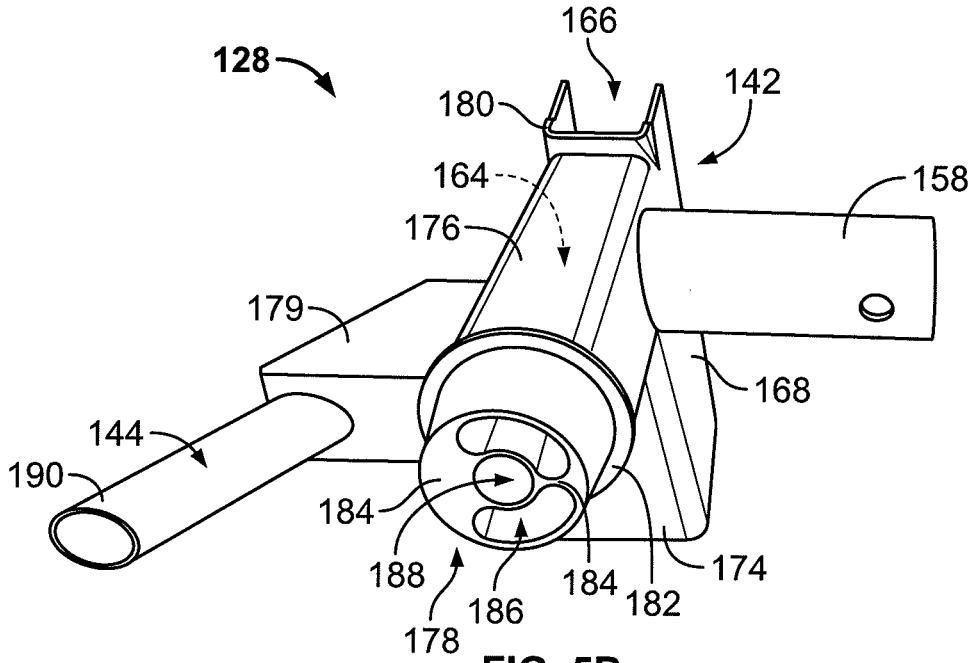
FIG. 5B is another perspective view showing the container filling device of FIG. 5A.
Figure 5C:
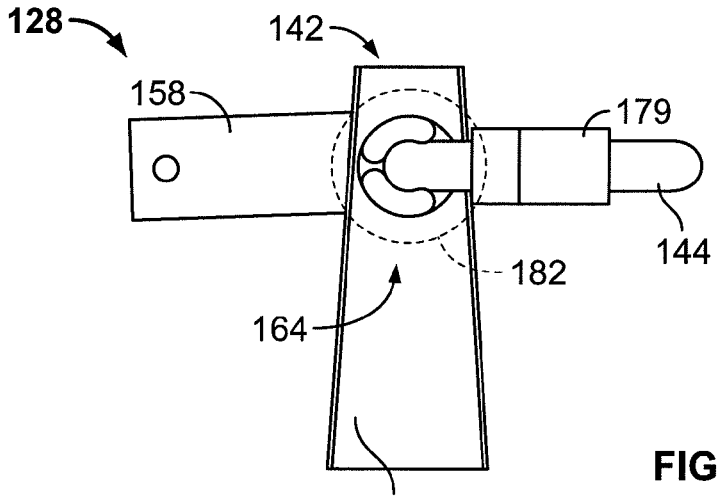
FIG. 5C is a top plan view showing the container filling device of FIGS. 5A and 5B.
Figure 5D:
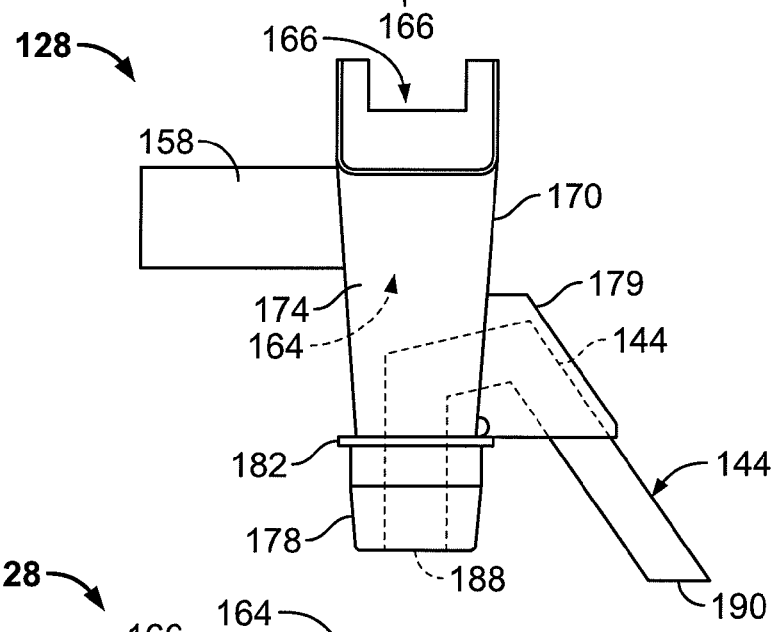
FIG. 5D is a left side elevational view showing the container filling device of FIGS. 5A-5C.
Figure 5E:
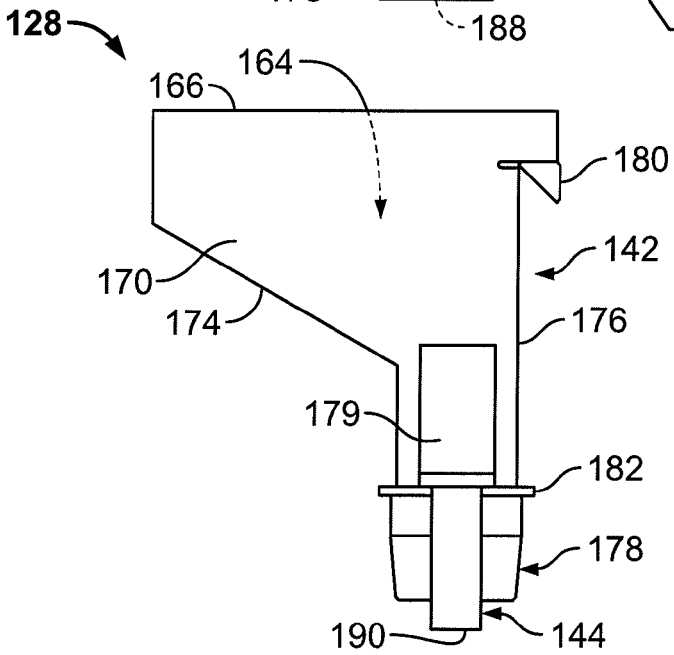
FIG. 5E is a front elevational view showing the container filling device of FIGS. 5A-5D.
Figure 6A:
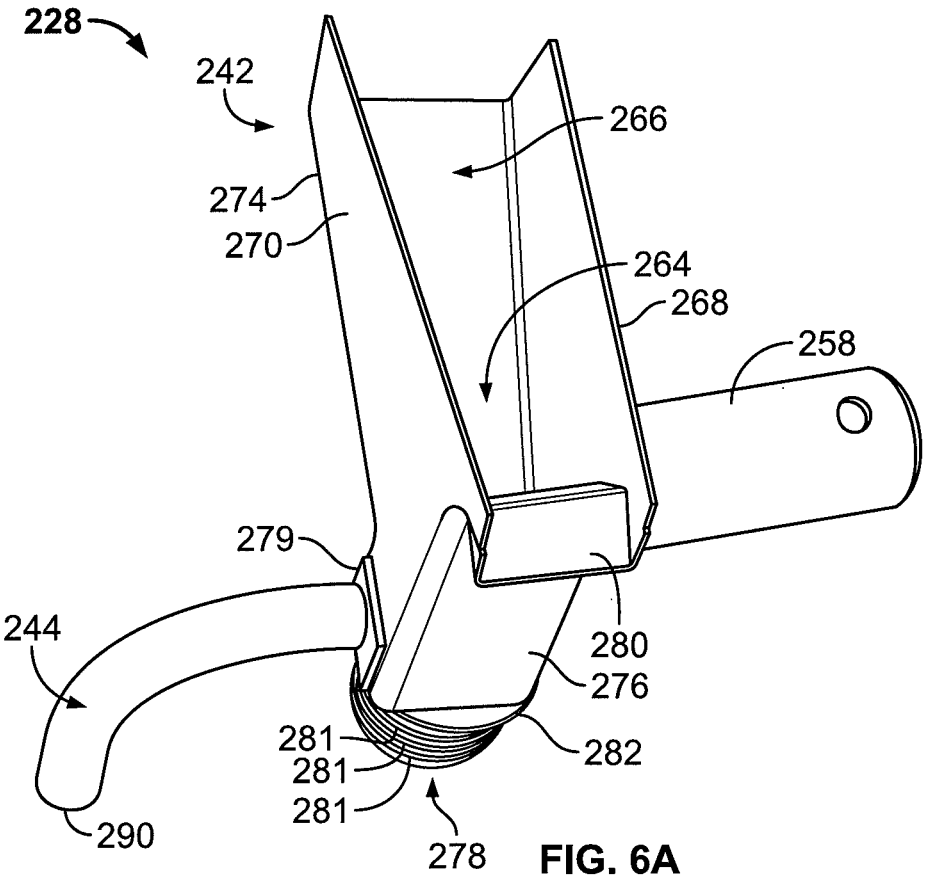
FIG. 6A is a perspective view showing a container filling device constructed in accordance with another embodiment of the present invention.
Figure 6B:
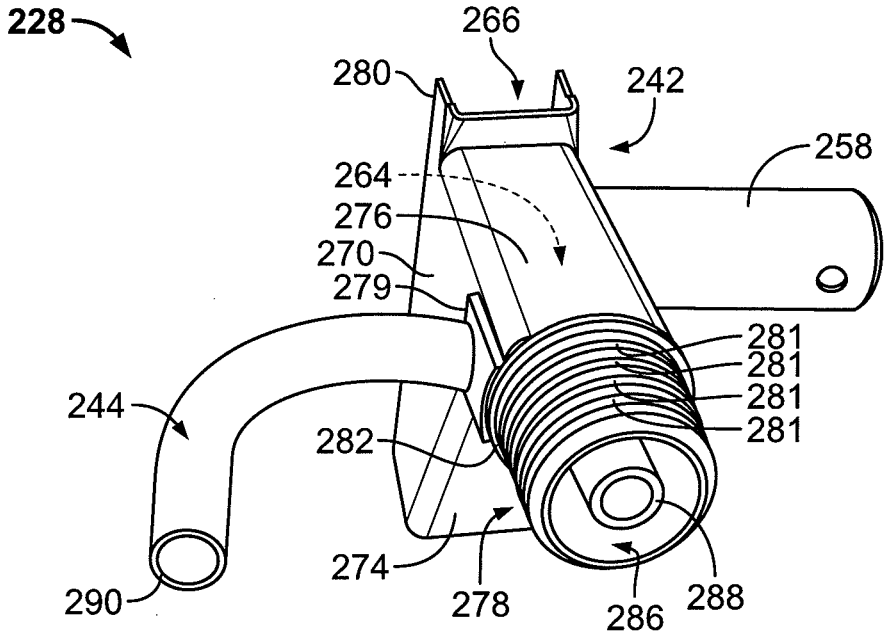
FIG. 6B is another perspective view showing the container filling device of FIG. 6A.
Figure 6C:
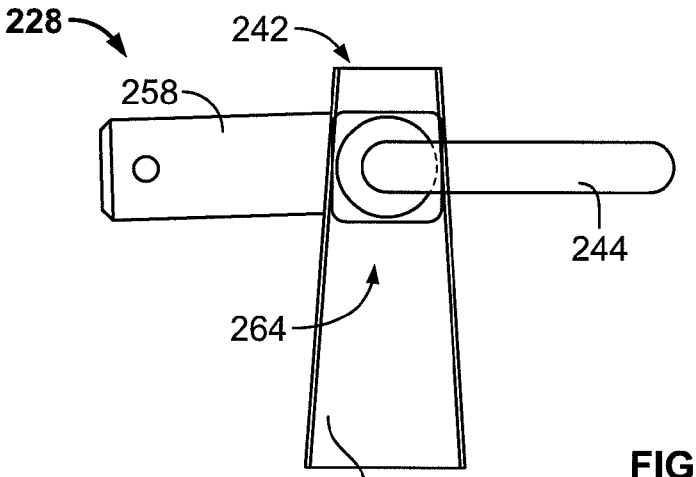
FIG. 6C is a top plan view showing the container filling device of FIGS. 6A and 6B.
Figure 6D:
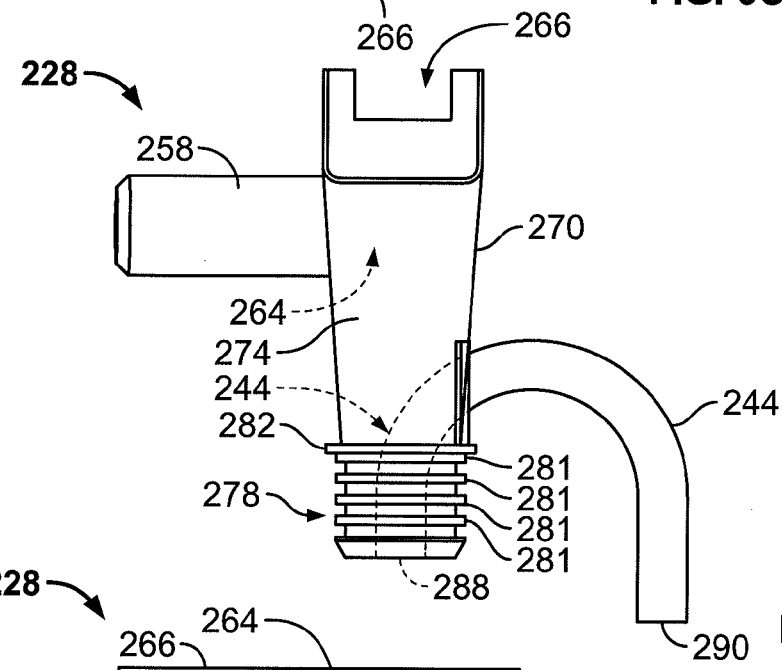
FIG. 6D is a left side elevational view showing the container filling device of FIGS. 6A-6C.
Figure 6E:
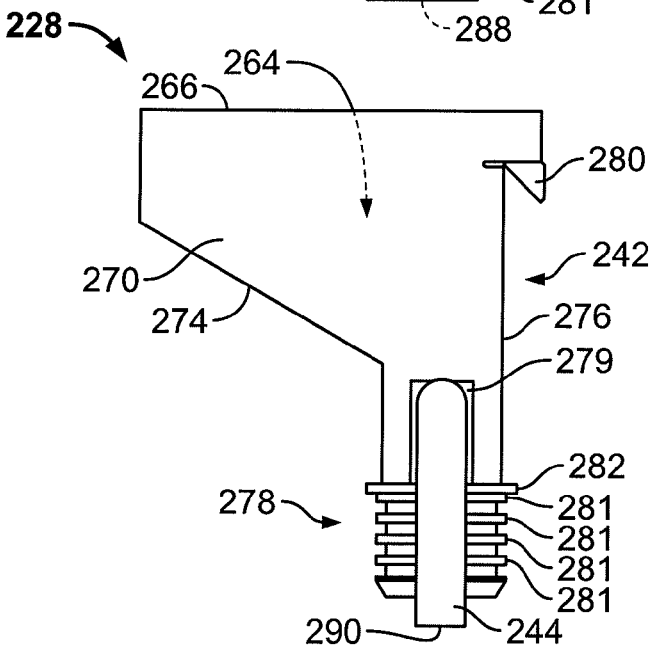
FIG. 6E is a front elevational view showing the container filling device of FIGS. 6A-6D.

The bottom region 78 can include supporting elements 84 that define a multi-chambered opening 86. For example, the embodiment of FIG. 4A shows a multi-chambered opening 86 that includes a central chamber and a plurality of sector-like chambers circumscribing the central chamber. As used herein, the term "multi-chambered opening" is used to include an opening having multiple chambers and/or a plurality of openings wherein each of the plurality of openings has one or more chambers. For example, at or proximal the bottom region 78, there is at least one opening for outflow of liquid from the receiving area 64 to the container 30 and at least one opening associated with the removal flow through the siphon 44.

The siphon 44 is preferably formed of tubing that extends continuously through the receiving area 64, the hole 72 of the front wall 70, and the central chamber (for example) of the multi-chambered opening 86. The chamber associated with the siphon 44 need not be centrally located. The tubing is formed integral with and/or as a separate component from the funnel 42. In some embodiments of the invention, the siphon 44 includes a first siphon end 88 extending out through the central chamber of the multi-chambered opening 86, and further includes a second siphon end 90 extending out from through the hole 72 in the front wall 70. The container filling device 38 can be provided with an element for supporting the siphon 44 proximal the second end 90, such as the rib 79 shown in FIGS. 4A-4D.

Regarding the positioning of the siphon 44, it is contemplated that the flange 82 might abut the top of the neck section 32 of bottle, such that a distance measured downwardly from the flange 82 to the first siphon end 188 would correspond (e.g., correlate) to the desired headspace in the bottle. An undesirably high elevation of liquid is evacuated by the first siphon end 88 for outflow from the second siphon end 90 at a lower elevation and into the trough 40 for recirculation back to the weir subsystem 38.

Referring to FIGS. 5A-5E, a container filling device 128 is shown constructed in accordance with another exemplary embodiment of the present invention. Elements illustrated in FIGS. 5A-5E which correspond substantially to the elements described above with reference to FIGS. 4A-4D have been designated by corresponding reference numerals increased by one hundred. The embodiment of the present invention shown in FIGS. 5A-5E is constructed and used in manners consistent with the foregoing description of the liquid filler system 20 and container filling device 28 of FIGS. 2A-4D unless it is stated otherwise.

The container filling device 128 of FIGS. 5A-5E includes a funnel 142 and siphon 144 that are formed integrally and/or otherwise. The container filling device 128 can be formed of stainless steel, for example, and can be provided with a deflecting member 180. The funnel 142 is provided with walls 168, 170, 174, 176 with an open top 166 and a liquid receiving area 164. A filling device mount 158 extends from the rear wall 168, and can be provided as a cylindrical extension with a bore therefore for direct connection to a fixed elevation member having complementary geometry thereto, e.g., a horizontal securing rod with a screw fastener (not shown). The funnel 142 tapers down to a bottom region 178 extending below a flange 182. The bottom region 178 can be sized and dimensioned to form at least a partial seal with a neck section 32 of a bottle 30 and has a complementary geometry to the neck section 32. The bottom region 178 includes or is otherwise provided with a multi-chambered opening 186 having a plurality of supporting elements 184 and a central chamber for receiving and/or defining an end of the siphon 144.

The siphon 144 preferably extends continuously through the front wall 170, the receiving area 164, and the central chamber (for example) of the multi-chambered opening 186. A first end 188 of the siphon 144 is provided at a first elevation, and a second end 190 of the siphon 144 is provided at a second elevation lower than the first elevation. The first end 188 can be substantially flush with the bottom plane of the bottom region 178 of the funnel 142 of the container filling device 128, such that the distance from the first end 188 to the flange 182 corresponds to a desired headspace. An element, e.g., block 179, can be provided for supporting the siphon 144 proximal the second end 190.

Referring to FIGS. 6A-6E, a container filling device 228 is shown constructed in accordance with another exemplary embodiment of the present invention. Elements illustrated in FIGS. 6A-6E which correspond substantially to the elements described above with reference to FIGS. 4A-4D have been designated by corresponding reference numerals increased by two hundred. The embodiment of the present invention shown in FIGS. 6A-6E is constructed and used in manners consistent with the foregoing description of the liquid filler system 20 and container filling device 28 of FIGS. 2A-4D unless it is stated otherwise.

The container filling device 228 of FIGS. 6A-6E includes a funnel 242 and siphon 244 that are molded from plastic and provided with a deflecting member 280. The funnel 242 is provided with walls 268, 270, 274, 276 with an open top 266 and a liquid receiving area 264. A filling device mount 258 is provided similar to the filling device mount 158 of FIGS. 5A-5E. The funnel 242 tapers down to a bottom region 278 extending below a flange 282. The bottom region 278 can be sized and dimensioned with a complementary geometry to the neck section 32 to form at least a partial seal with the neck section 32 of a bottle 30, and a plurality of O-rings 281 circumscribe the bottom region 278 to further facilitate same. The bottom region 278 includes a multi-chambered opening 286 with a central chamber (a first end 288 of the siphon 244) and an outflow chamber circumscribing the central chamber. A first end 288 of the siphon 244 is provided at a first elevation, and a second end 290 of the siphon 244 is provided at a second elevation lower than the first elevation. The first end 288 can be substantially flush with the bottom plane of the funnel 242. An element, e.g., plate 279, can be provided for supporting the siphon 244.

Further discussion shall now be had with regards to an exemplary method for filling a container, such as a bottle. In an exemplary embodiment of the method, a continuous flow of liquid is operated from a weir subsystem, through a bottle filling area, and into a trough. A turret is rotated, and the turret is provided with a plurality of container filling devices positioned thereabout, each container filling device including a siphon and a funnel. The turret is provided with a plurality of receiving forks positioned thereabout in alignment with a corresponding one of the container filling devices. Bottles are loaded onto the receiving forks from an assembly line using a first star wheel. The bottles are engaged with the container filling devices in the bottle filling area, such that the funnel diverts the downwardly flowing liquid so as to fill the bottles, and where the siphons can evacuate liquid from the bottles into the trough to form a desired headspace in the filled bottles. The bottles are unloaded from the turret to the assembly line using a second star wheel.

Figure 7A:
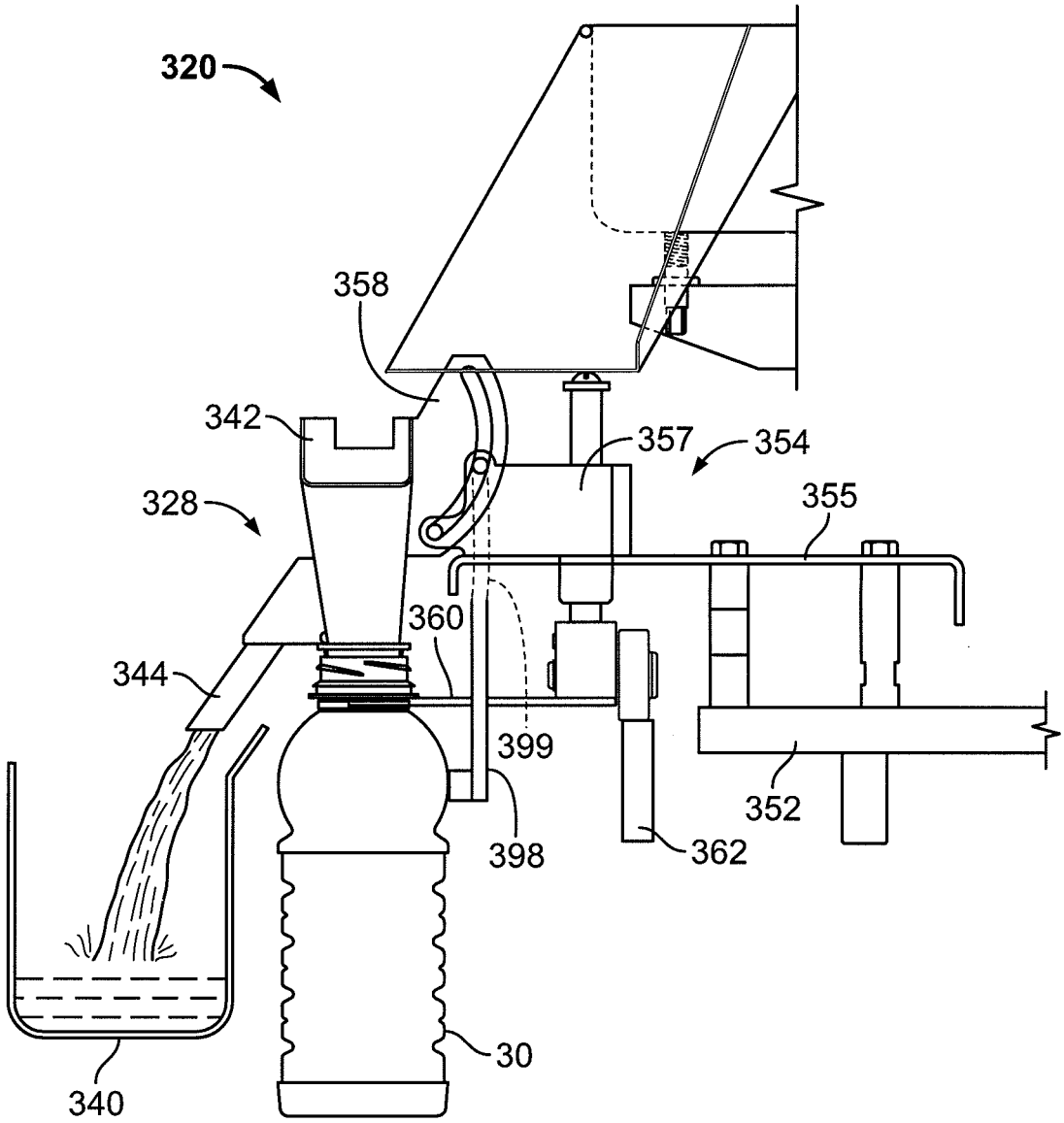
FIG. 7A is a front elevational view of a liquid filler system constructed in accordance with another embodiment of the present invention showing (i) a trough displaced radially outward from a container filling device relative to the turret and (ii) an assembly biased for rotating the container filling device toward the trough, the container filling device being shown to have engaged a bottle.
Figure 7B:
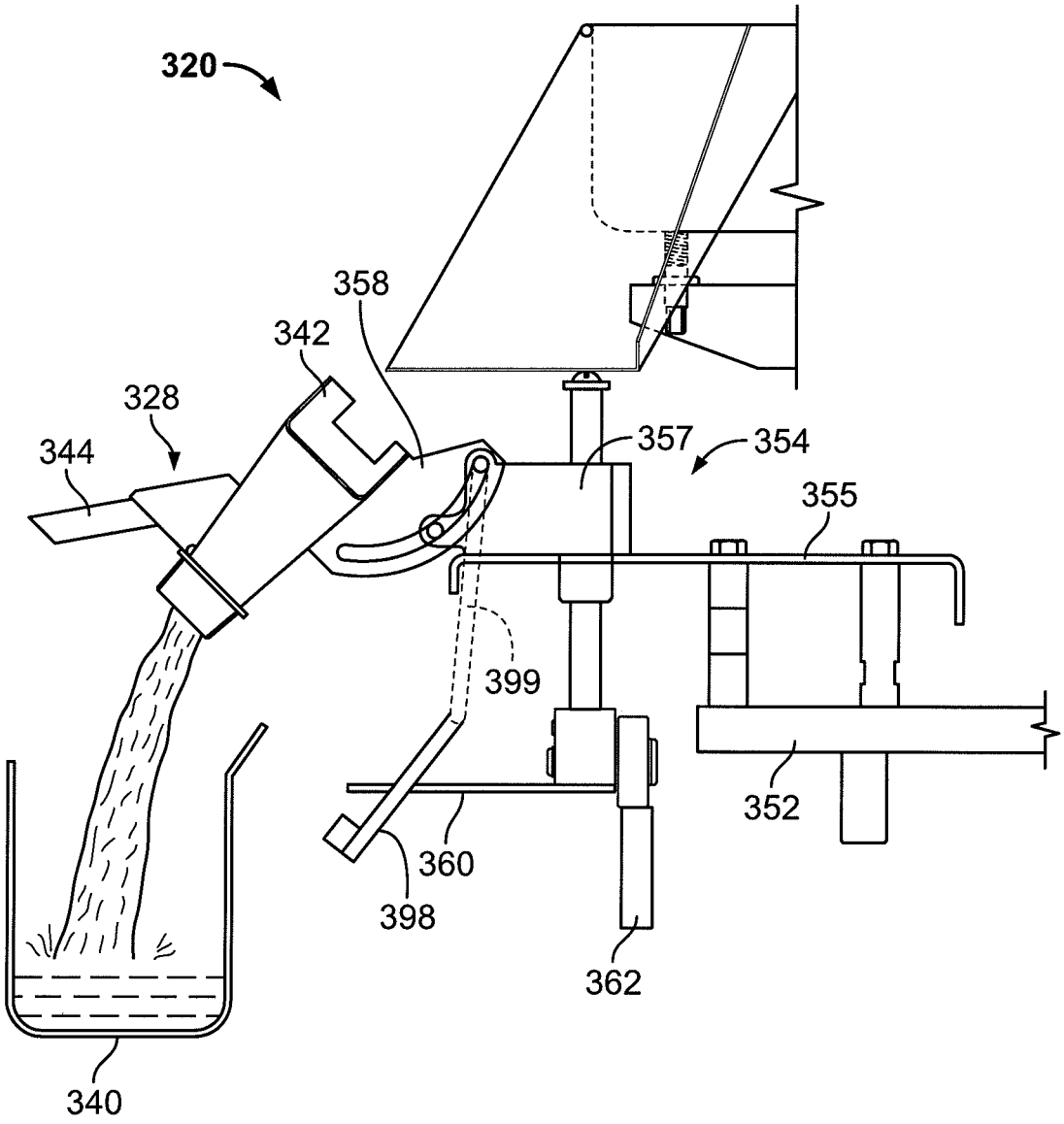
FIG. 7B is the front elevational view of FIG. 7A showing the container filling device having been disengaged from the bottle so as to divert liquid from within the container filling device toward the trough.

Referring to FIGS. 7A-7B, a liquid filler system 320 is shown constructed in accordance with an exemplary embodiment of the present invention. Elements illustrated in FIGS. 7A and 7B which correspond substantially to the elements described above with reference to FIGS. 2A-4D have been designated by corresponding reference numerals increased by three hundred. The embodiment of the present invention shown in FIGS. 7A and 7B is constructed and used in manners consistent with the foregoing description of the liquid filler system 20 of FIGS. 2A-4D unless it is stated otherwise.

With reference to FIGS. 7A and 7B, a trough 340 is provided to be displaced radially from the bottle 30 with respect to the turret 352. Whereas the trough 40 of FIGS. 2A-3B is shown to be below the shared annular path of the bottles 30 and container filling devices 28, the trough 340 is shown displaced from the annular path of the container filling devices 328 so as to be substantially concentric therewith. As shown in FIGS. 7A and 7B, the trough 340 is displaced radially outward of the path of the container filling devices 328.

One advantage to having the trough 340 spaced from the path of the container filling devices 328 and bottles 30 is to further decrease the level of contaminants of the bottle 30 that might spill into the trough 340 with excess liquid flow. In the embodiment of FIGS. 7A and 7B, when the bottles 30 are engaged with the container filling device 328, overflow is siphoned from inside the bottle 30 into the trough 340 for recirculation, while any leakage up and out of the neck section 32 (through the seal or just after disengagement of the seal), together with any contaminants on the outside of the bottle 30, spill to a location outside of the trough 340, thereby minimizing circulation of such contaminant into the circulation of the plumbing system.

After the container filling device 328 is disengaged from the bottle 30, some remaining liquid may flow out of the funnel 342, though it is desirable that such remaining liquid flow to the trough 340. To facilitate the flow of the liquid to a trough 340 radially displaced from the path of the container filling devices 328, a filling device mount includes a spring-loaded (or otherwise biased) rotatable assembly 358 that is secured to the fixed elevation member 357, which in turn connects to an extension mount 355 for the turret 352.

The rotatable assembly 158 is provided with a bias, e.g., a spring-bias. An actuator 398 is provided below the fork 360 with linkage 399 (shown schematically) for mechanical communication with the rotatable assembly 358, such that the absence of the weight of the bottle 30 is a state in which the default spring bias of the rotatable assembly 358 points the container filling device toward the trough 340 so as to divert outflow from the bottom region of the funnel 342 to the trough 340, as shown in FIG. 7B, for example. When the fork 360 receives a bottle 30, the weight of the bottle 30 pushes on the actuator 398, which is in mechanical communication with the rotatable assembly 358 via linkage 399 to bring the container filling device 328 into alignment with the bottle 30 as shown in FIG. 7A, for example.

It will be understood that the embodiments of the present invention described herein are merely exemplary and that a person skilled in the art may make many variations and modifications without departing from the spirit and scope of the invention. All such variations and modifications, including those discussed above, are intended to be included within the scope of the invention as defined in the appended claims.

What is claimed is:

1. A container filling device, comprising:

a funnel having a receiving area for receiving the inflow of liquid and a bottom region configured to engage an open neck section of a container, said bottom region having an opening for the outflow of fluid from said receiving area to the container; and a siphon extending through said receiving area, said siphon including a first end substantially flush with a bottom plane of said bottom region and terminating at a first elevation and further including a second end terminating outside said receiving area at a second elevation less than said first elevation, wherein said siphon, in use, evacuates liquid from the container to create a headspace;

wherein said bottom region includes a multi-chambered opening having a plurality of supporting elements.

2. The container filling device of claim 1, wherein said funnel is provided with a flange circumscribing a plurality of walls of said funnel.

3. The container filling device of claim 2, wherein a distance from said flange to said first end corresponds with a size of the headspace.

4. The container filling device of claim 1 in combination with the container.

5. The combination of claim 4, wherein said bottom region forms at least a partial seal with the container in use.

6. The container filling device of claim 5, including an O-ring encircling said bottom region.

7. The container filling device of claim 1, wherein said siphon is formed integrally with said funnel.

8. The container filling device of claim 1, wherein said multi-chambered opening includes a central chamber defining said first end of said siphon.

9. A container filling device, comprising:

a funnel having a receiving area for receiving the inflow of liquid and a bottom region configured to engage an open neck section of a container, said bottom region having an opening for the outflow of fluid from said receiving area to the container;

a siphon extending through said receiving area, said siphon including a first end substantially flush with a bottom plane of said bottom region and terminating at a first elevation and further including a second end terminating outside said receiving area at a second elevation less than said first elevation, wherein said siphon, in use, evacuates liquid from the container to create a headspace; and a filling device mount for securingly mounting said container filling device to a fixed elevation member of a turret of a liquid filler system.

10. The container filling device of claim 9, wherein said filling device mount is spring-biased to be rotatable with respect to the fixed elevation member.

11. A liquid filler system for filling a container with a headspace, comprising:

a container filling device including (i) a funnel provided with a receiving area and a bottom region configured to engage a container with a neck section, said bottom region having a multi-chambered opening including an opening for the outflow of liquid from said funnel to the container and (ii) a siphon with a first end extending through said bottom region to a first elevation and a second end extending to a second elevation lower than said first end, said multi-chambered opening including at least a portion of said siphon;

a plumbing system configured to deliver liquid to said receiving area and to receive overflow of liquid from said second end; and an alignment system configured to so engage said bottom region with the container to siphon liquid from the container corresponding to the headspace.

12. The liquid filler system of claim 11, wherein said funnel is provided with a flange circumscribing a plurality of walls of said funnel.

13. The liquid filler system of claim 12, wherein a distance from said flange to said first end corresponds with a size of the headspace.

14. The liquid filler system of claim 11 in combination with the container.

15. The liquid filler system of claim 11, wherein said bottom region forms at least a partial seal with the container when so engaged.

16. The liquid filler system of claim 11, wherein said first end is flush with a bottom plane of said bottom region.

17. The liquid filler system of claim 11, where said alignment system includes a turret and star wheel configuration to so engage said bottom region with the container.

18. The liquid filler system of claim 17, wherein said plumbing system includes a trough configured to receive overflow of liquid from said second end of said tube.

19. The liquid filler system of claim 18, including a filling device mount for securingly mounting said container filling device relative to said turret.

20. The liquid filler system of claim 19, wherein said trough is displaced radially from a path of said container filling device.

21. The liquid filler system of claim 20, wherein said trough receives liquid from said container filling device when so engaged with the container and when disengaged therefrom.

22. The liquid filler system of claim 21, wherein said filling device mount is rotatable to point said container filling device toward said trough to divert outflow from said bottom region to said trough.

23. The liquid filler system of claim 11, wherein said bottom region includes a multi-chambered opening having a plurality of supporting elements.

24. The liquid filler system of claim 23, wherein said multi-chambered opening includes a central chamber defining said first end of said siphon.

25. A container filling device, comprising:

a funnel having a receiving area for receiving the inflow of liquid and a bottom region configured to engage an open neck section of a container, said bottom region having a multi-chambered opening including a plurality of supporting elements and a central chamber for the outflow of fluid from said receiving area to the container; and a siphon extending through said receiving area, said siphon including a first end extending through said bottom region and terminating at a first elevation and further including a second end terminating outside said receiving area at a second elevation less than said first elevation, wherein said siphon, in use, evacuates liquid from the container to create a headspace.

26. The container filling device of claim 25, wherein said funnel is provided with a flange circumscribing a plurality of walls of said funnel.

27. The container filling device of claim 26 wherein a distance from said flange to said first end corresponds with a size of the headspace.

28. The container filling device of claim 25 in combination with the container.

29. The combination of claim 28, wherein said bottom region forms at least a partial seal with the container in use.

30. The container filling device of claim 29, including an O-ring encircling said bottom region.

31. The container filling device of claim 25, wherein said siphon is formed integrally with said funnel.

32. The container filling device of claim 25, wherein said first end extends below said bottom region.

33. The container filling device of claim 25, including a filling device mount for securingly mounting said container filling device to a fixed elevation member of a turret of a liquid filler system.

34. The container filling device of claim 33, wherein said filling device mount is spring-biased to be rotatable with respect to the fixed elevation member.

35. The container filling device of claim 25, wherein first end of said siphon is substantially flush with a bottom plane of said bottom region.

36. A container filling device, comprising:

a funnel having a receiving area for receiving the inflow of liquid and a bottom region configured to engage an open neck section of a container, said bottom region having an opening for the outflow of fluid from said receiving area to the container;

a siphon extending through said receiving area, said siphon including a first end extending through said bottom region and terminating at a first elevation and further including a second end terminating outside said receiving area at a second elevation less than said first elevation, wherein said siphon, in use, evacuates liquid from the container to create a headspace; and a filling device mount for securingly mounting said container filling device to a fixed elevation member of a turret of a liquid filler system.

37. The container filling device of claim 36, wherein said funnel is provided with a flange circumscribing a plurality of walls of said funnel.

38. The container filling device of claim 37, wherein a distance from said flange to said first end corresponds with a size of the headspace.

39. The container filling device of claim 36 in combination with the container.

40. The combination of claim 39, wherein said bottom region forms at least a partial seal with the container in use.

41. The container filling device of claim 40, including an O-ring encircling said bottom region.

42. The container filling device of claim 36, wherein said siphon is formed integrally with said funnel.

43. The container filling device of claim 36 in combination with (i) a plumbing system configured to deliver liquid to said receiving area and to receive overflow of liquid from said second end; and (ii) an alignment system configured to so engage said bottom region with the container to siphon liquid from the container corresponding to the headspace.

44. The combination of claim 43, wherein said funnel is provided with a flange circumscribing a plurality of walls of said funnel.

45. The combination of claim 44, wherein a distance from said flange to said first end corresponds with a size of the headspace.

46. The combination of claim 43 in further combination with the container.

47. The combination of claim 43, wherein said bottom region forms at least a partial seal with the container when so engaged.

48. The combination of claim 43, wherein said first end is flush with a bottom plane of said bottom region.

49. The combination of claim 43, where said alignment system includes a turret and star wheel configuration to so engage said bottom region with the container.

50. The combination of claim 49, wherein said plumbing system includes a trough configured to receive overflow of liquid from said second end of said tube.

51. The combination of claim 50, wherein said trough is displaced radially from a path of said container filling device.

52. The combination of claim 51, wherein said trough receives liquid from said container filling device when so engaged with the container and when disengaged therefrom.

53. The combination of claim 52, wherein said filling device mount is rotatable to point said container filling device toward said trough to divert outflow from said bottom region to said trough.

* * * * *